US005458527A

United States Patent [19]

Kondo et al.

[11] Patent Number: 5,458,527

[45] Date of Patent: Oct. 17, 1995

[54] GRINDING WHEEL WEAR COMPENSATOR

[75] Inventors: Toshiaki Kondo; Masakazu Kozono, both of Hirakata, Japan

[73] Assignee: Komatsu Ltd., Osaka, Japan

[21] Appl. No.: 67,991

[22] Filed: May 27, 1993

[30] Foreign Application Priority Data

May 27, 1992 [JP] Japan ..... 4-135279

[51] Int. Cl.[6] ..... B24B 49/12

[52] U.S. Cl. ..... 451/21; 451/6; 451/9

[58] Field of Search ..... 51/165.87, 165.71, 51/165.72, 165.75; 451/21, 5, 6, 9

[56] References Cited

FOREIGN PATENT DOCUMENTS 0225089 7/1985 Germany ..... 51/165.72

0281872 11/1989 Japan ..... 51/165.87

9008012 7/1990 WIPO ..... 51/165.72

*Primary Examiner*—Robert A. Rose

*Attorney, Agent, or Firm*—Senniger, Powers, Leavitt & Roedel

[57] ABSTRACT

A grinding wheel wear compensator for determining a correct position for a grinding wheel that wears in grinding operation performed on a workpiece so that high grinding accuracy can be ensured.

In the grinding wheel wear compensator, in accordance with a desired grinding pattern, a tool centre determining unit determines a tool centre point from a two-dimensional section of the grinding wheel, the section being cut off in an axial direction of the grinding wheel so as to pass its rotary axis and detected by a section detecting unit. Based on the positional difference between the tool centre point determined and a reference point, a wear correction value calculating unit calculates a wear correction value to be used for determining the correct position for the grinding wheel.

9 Claims, 9 Drawing Sheets

FIG. (3)

FIG. (6A)
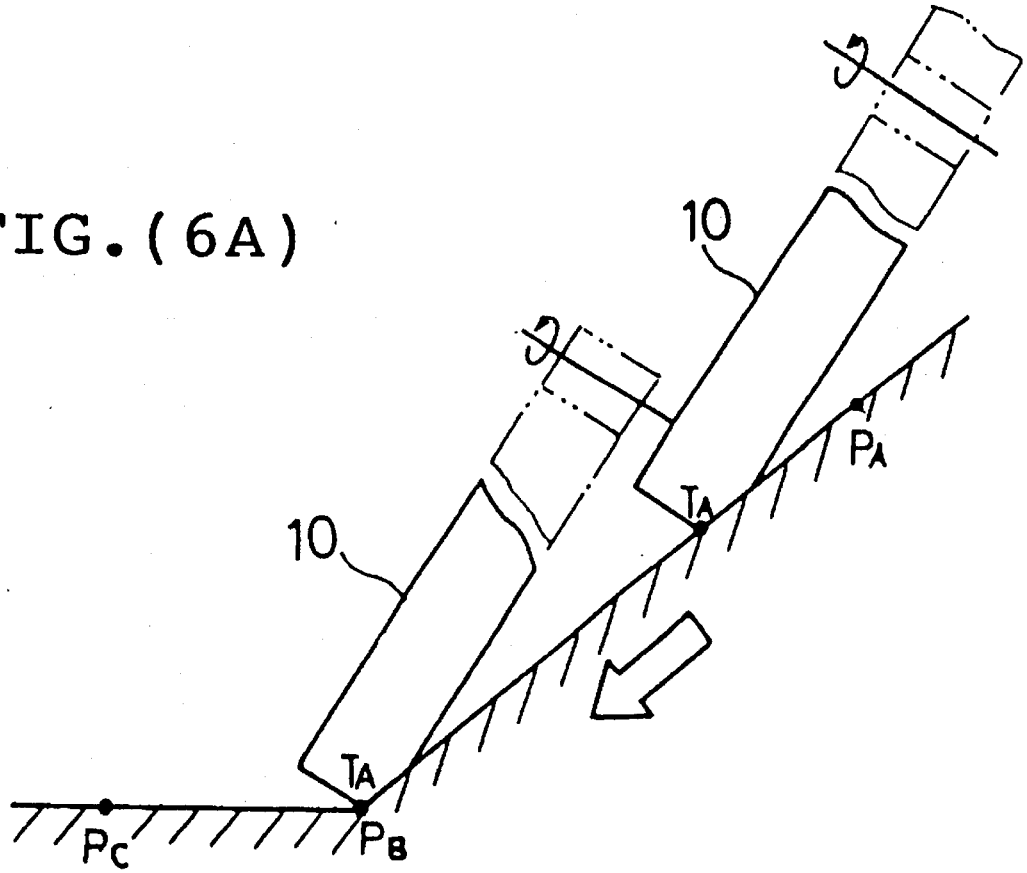
FIG. (6B)
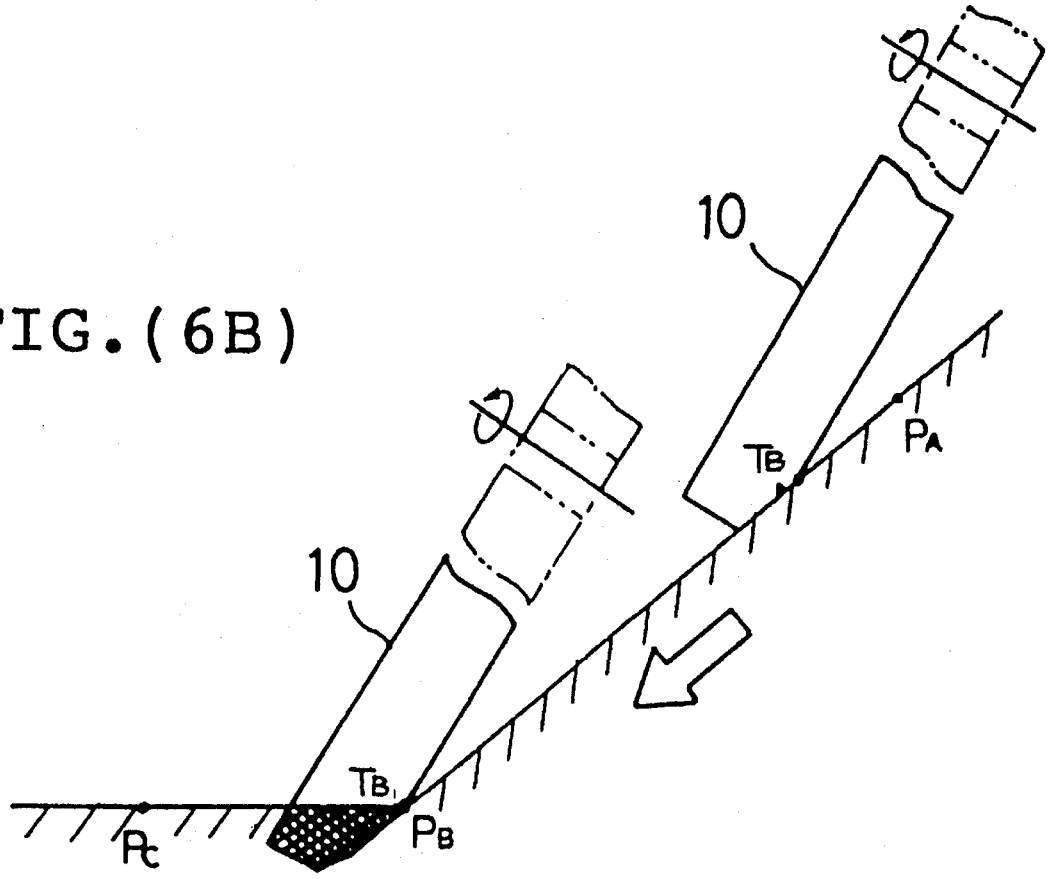

FIG. (7A)
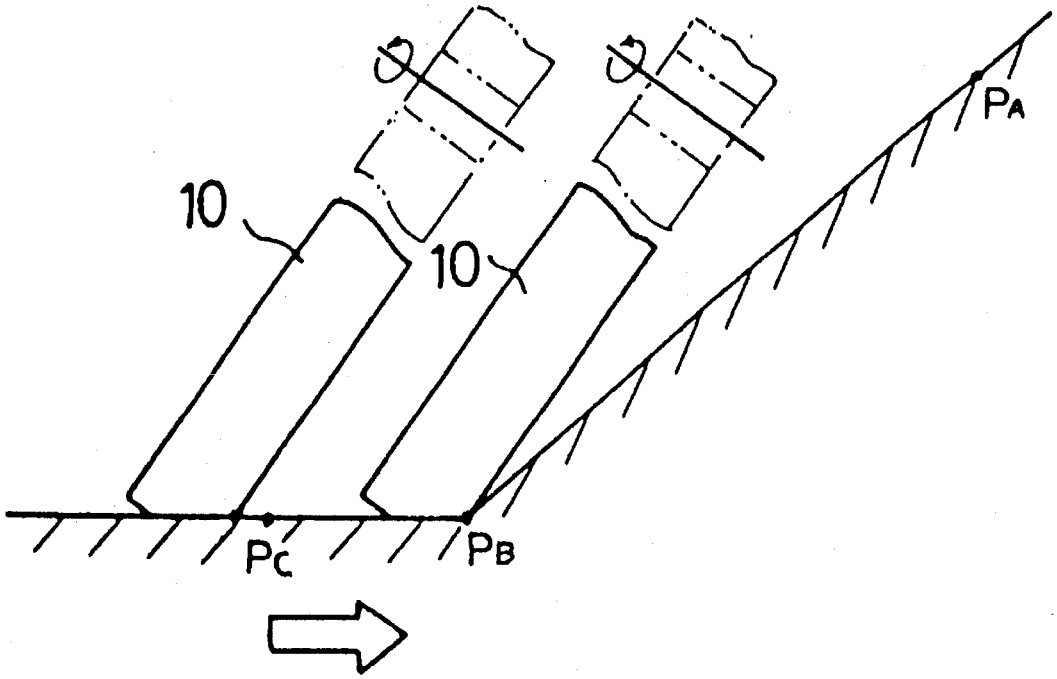
FIG. (7B)
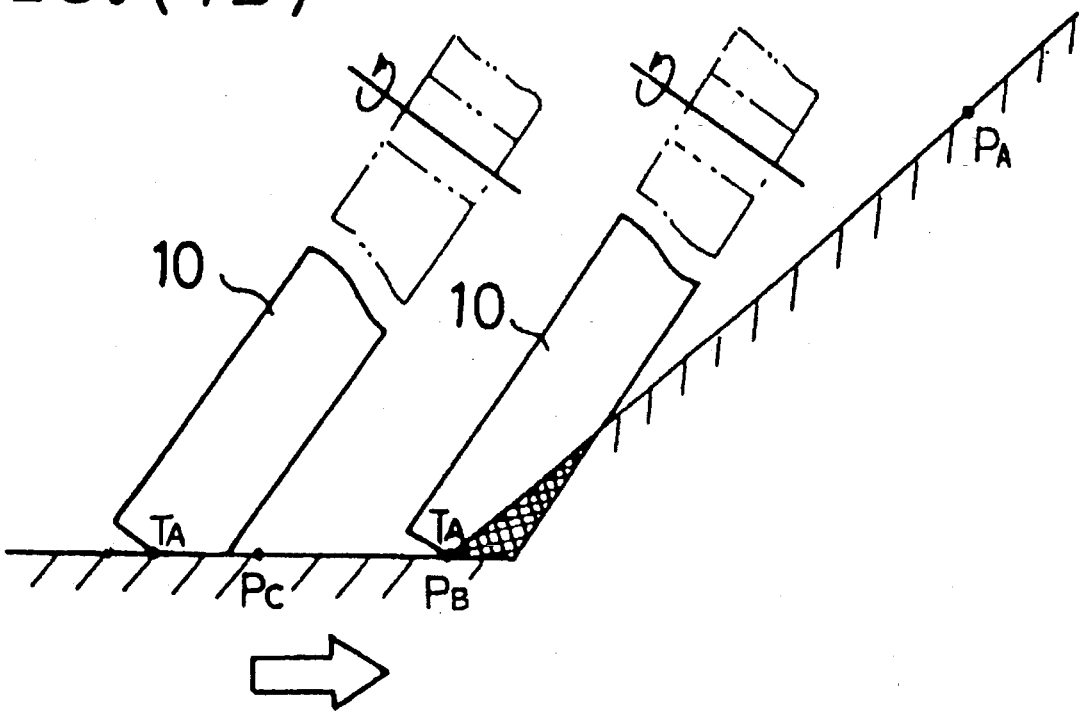

GRINDING WHEEL WEAR COMPENSATOR

BACKGROUND OF THE INVENTION (1) Field of the Invention

The present invention relates to a grinding wheel wear compensator and, more particularly, to a grinding wheel wear compensator for determining a correct position for a grinding wheel that wears in grinding operation performed on a workpiece.

(2) Prior Art

A grinding wheel used in grinding operation performed on a workpiece gradually wears at its periphery portion as the operation proceeds. If the wear of the grinding wheel is not compensated for, the accuracy of the grinding operation performed on a workpiece will deteriorate.

In order to assure high grinding accuracy, when the grinding operation is to be performed, it is necessary to compensate for the wear amount of a grinding wheel before starting operation or for every specified period of time or every specified operation amount in the course of continuous operation, by shifting the grinding wheel towards the processing face of a workpiece in accordance with the wear amount so that the grinding operation can be substantially constantly performed.

In one known apparatus, in order to obtain a wear amount, the outer diameter of a grinding wheel is measured by detecting a position in the periphery of the grinding wheel with a photoelectric sensor disposed at the periphery of the grinding wheel.

SUMMARY OF THE INVENTION

The above prior apparatus, however, has the disadvantage that since a wear amount is obtained from the size of the outer diameter of the grinding wheel and a tool centre point is determined based on the outer diameter size, wear compensation can be performed on the grinding wheel only in a radial direction thereof but cannot be performed in an axial direction. This results in poor grinding accuracy.

It is therefore an object of the invention to provide a grinding wheel wear compensator capable of determining a correct position for a worn grinding wheel so as to achieve a high degree of grinding accuracy for the finished article, thereby overcoming the foregoing problem.

In order to accomplish the above object, a grinding wheel wear compensator according to the Invention comprises:

(a) section detecting means for detecting a two-dimensional section of a grinding wheel, the section being cut off in an axial direction of the grinding wheel so as to pass a rotary axis of the grinding wheel;

(b) tool centre determining means for determining, in accordance with a desired grinding pattern, a tool centre point from the two-dimensional section of the grinding wheel which is cut off in an axial direction of the grinding wheel so as to pass its rotary axis and is detected by the section detecting means; and (c) wear correction value calculating means for calculating a wear correction value used for determining a correct position for the grinding wheel, based on the positional difference between the tool centre point determined by the tool centre determining means and a reference point.

In the above arrangement, according to a desired grinding pattern such as, for example, "push-cutting" and "draw-cutting", a tool centre point is determined from a detected two-dimensional section of the grinding wheel, the section being cut off in an axial direction of the grinding wheel so as to pass its rotary axis. A wear correction value used for determining a correct position for the grinding wheel is then calculated based on the positional difference between the tool centre point that has been determined and a reference point which is, for example, a tool centre point for an unused grinding wheel. The position of the grinding wheel is corrected in accordance with the wear correction value thus calculated.

According to the invention, since a tool centre point 1s determined from a two-dimensional section of the grinding wheel, the section being cut off in an axial direction of the grinding wheel so as to pass its rotary axis, and a correct position for the grinding wheel is determined based on this tool centre point, the position of the grinding wheel being worn can be well corrected so that high grinding accuracy can be ensured for the finished article.

The above section detecting means may be formed with any of the following arrangements:

1. it is comprised of (i) a laser displacement meter or ultrasonic range finder which is moved relative to the grinding wheel disposed in a fixed position, in a radial direction of the grinding wheel and which measures the distance between the grinding wheel and the laser displacement meter or ultrasonic range finder, and (ii) a linear scale for measuring the traveling distance of the laser displacement meter or ultrasonic range finder in a radial direction of the grinding wheel;
2. it is comprised of (i) a laser displacement meter or ultrasonic range finder which is moved relative to the grinding wheel at a specified speed in a radial direction of the grinding wheel and which measures the distance between the grinding wheel and the laser displacement meter or ultrasonic range finder; or
3. it is comprised of (i) slit light projecting means for projecting a slit light to the grinding wheel from a side thereof so that the lengthwise direction of a slit light spot locates along the radial direction and the rotary axis of the grinding wheels, and (ii) photographing means for taking a picture of the slit light projected to the grinding wheel by the slit light projecting means.

The two-dimensional section of the grinding wheel, which is cut off in an axial direction of the grinding wheel so as to pass its rotary axis and is detected by the above section detecting means, is taken from the outer contour of a phantom image of the grinding wheel created when being rotated.

When a tool centre point is determined by the tool centre determining means, the tool centre point may be determined based on an actual grinding angle of the grinding wheel, and with the actual grinding angle, grinding operation may be performed. An alternative is such that at least a first grinding angle that is optimum for grinding operation and a second grinding angle that is used when the grinding wheel is wearing flatly are preliminarily set, and a tool centre point is determined and grinding is performed with the first grinding angle as far as the operation is normally performed, and if the grinding wheel begins to wear flatly with the first grinding angle, the second angle is used for determining a tool centre point and performing the grinding operation.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 1 to 7 are for explaining an embodiment wherein a grinding wheel wear compensator according to the invention is employed in a robot system for grinding operation;

FIG. 1 is a block diagram of the system showing its whole structure;

FIG. 2 is a diagram illustrating a measurement of a two-dimensional section of a grinding wheel, the measurement being described in conjunction with the description of FIG.

FIG. 3 is a flow chart of an operation program described in conjunction with the description of FIG. 1;

FIG. 4 shows X-Y coordinates in which a two-dimensional section of an unused grinding wheel is plotted, the two-dimensional section of the unused grinding wheel being described in conjunction with the description of FIG. 3;

FIG. 5 shows X-Y coordinates in which a two-dimensional section of a grinding wheel in a worn state is plotted, the two-dimensional section of the grinding wheel in a worn state being described in conjunction with the description of FIG. 3;

FIGS. 6(A) and 6(B) are for explaining a grinding pattern "push-cutting" that is described in conjunction with the description of FIG. 3;

FIGS. 7(A) and 7(B) are for explaining a grinding pattern "draw-cutting" that is described in conjunction with the description of FIG. 3;

FIG. 8 shows X-Y coordinates in which a two-dimensional section of a grinding wheel in a worn state is plotted;

FIG. 9 is a flow chart; and

DESCRIPTION OF THE PREFERRED EMBODIMENTS

Figure 1:
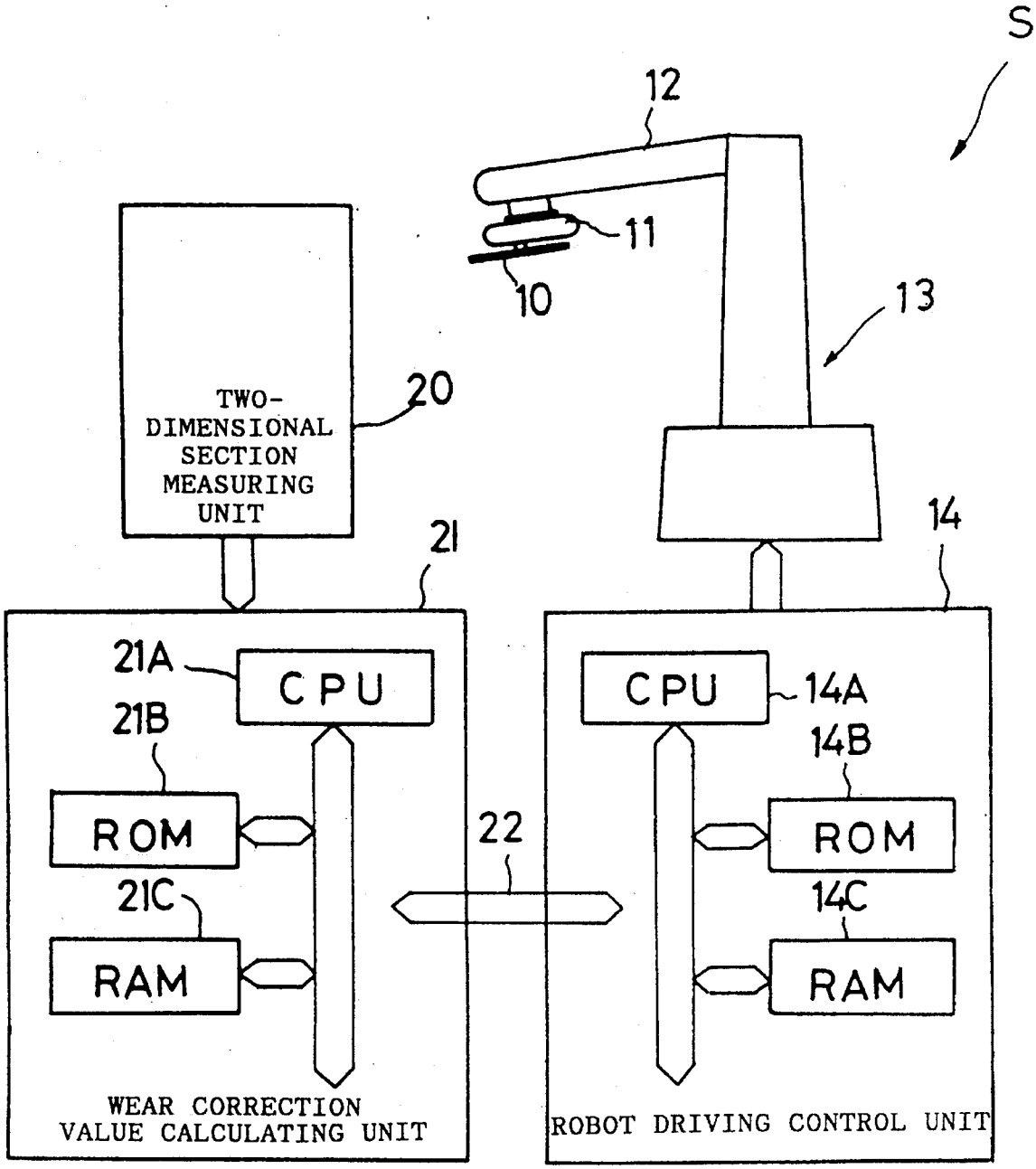

Referring now to the drawings, a grinding wheel wear compensator according to an embodiment of the invention will be concretely described. In this embodiment, the grinding wheel wear compensator is applied to a robot system for grinding operation.

Figure 2:
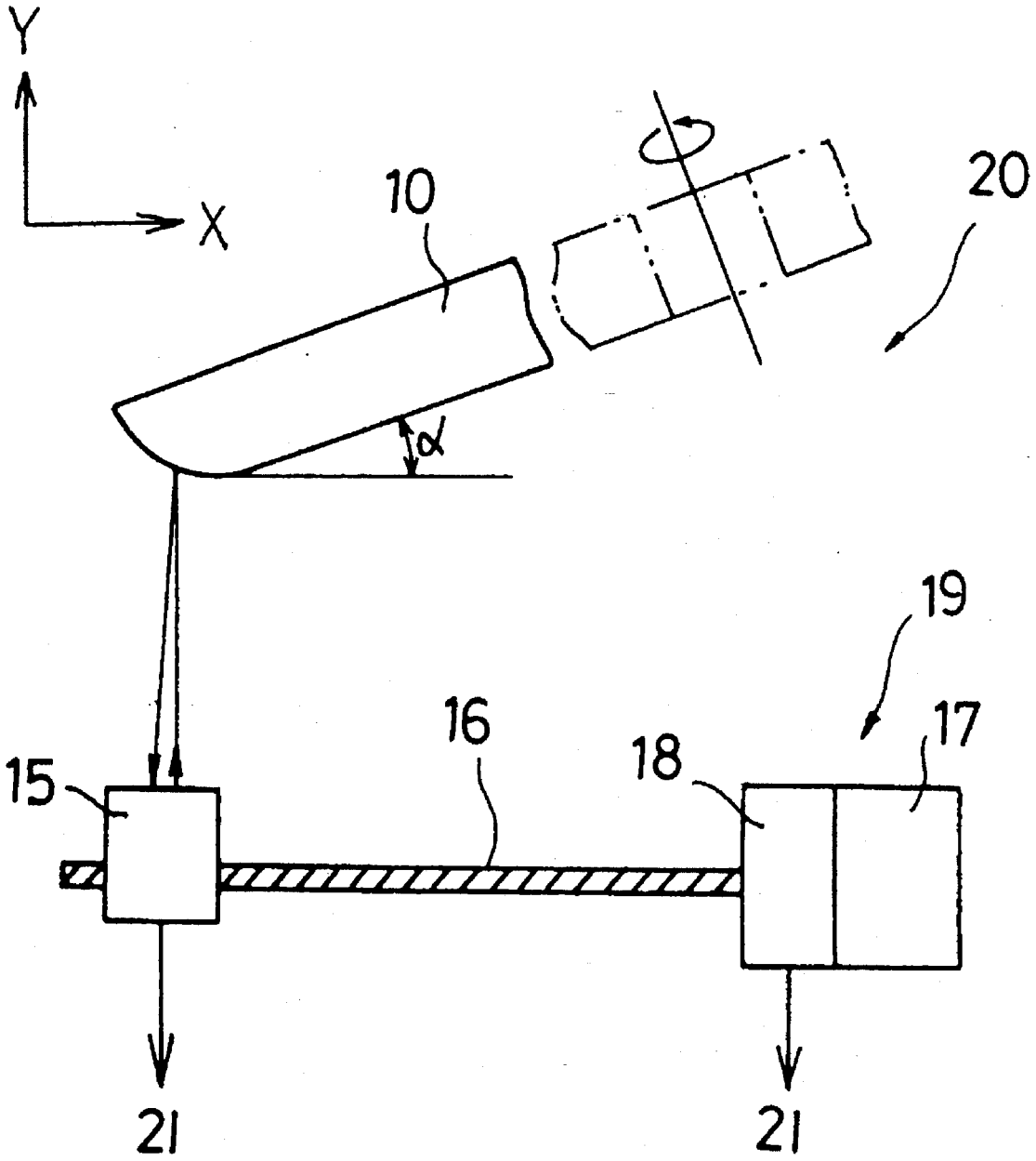

FIG. 1 shows a robot system S for grinding operation which is comprised of a robot 13 having an operating arm 12 that is moved relative to the grinding face of a workpiece at a specified speed when a grinding pattern such as "push-cutting" or "draw-cutting" is selected, grinder 11 between a grinding wheel 10 and the operating arm 12 rotates wheel 10 at a desired rotating rate. A robot driving control unit 14 controls the driving operation of the robot 13, more particularly, controls the rotation of the grinding wheel 10 and the position and movement of the operating arm 12. The robot system S is further provided with a two-dimensional section measuring unit 20 and a wear correction value calculating unit 21. The two-dimensional section measuring unit 20 is composed of a combination of a measuring device such as an ultrasonic range finder or a laser displacement meter 15 and a linear scale 19. The laser displacement meter 15 functions to measure a vertical distance from it to the grinding wheel 10 that is attached to the operating arm 12 (not shown in FIG. 2) and rotates at a specified position, being inclined at a tilt angle $\alpha$ as shown in FIG. 2. The linear scale 19 measures the traveling distance of the laser displacement meter 15 with an encoder 18, the laser displacement meter 15 being moved horizontally in a radial direction of the grinding wheel 10 by rotating a feed screw mechanism 16 with a motor 17 as shown in FIG. 2. The feed screw 16 is helically fitted into the laser displacement meter 15 and engaged with the encoder 18. The wear correction value calculating unit 21 is for calculating a wear correction value used for determining a correct position for the grinding wheel 10, based on a two-dimensional section of the grinding wheel 10, the section being cut off in an axial direction of the grinding wheel 10 so as to pass its rotary axis. The two-dimensional section is detected upon receipt of (1) a displacement distance value supplied from the laser displacement meter 15 of the two-dimensional section measuring unit 20 through an A/D convertor (not shown) where data from the laser displacement meter 15 is converted into a digital form; and (ii) a traveling distance value supplied from the linear scale 19, more particularly, from the encoder 18. The robot driving control unit 14 supplies data to the wear correction value calculating unit 21 through a bus 22 for every specified period of time or every specified operation amount. Among the above data are (1) instructions for the measurement of a two-dimensional section and the calculation of a wear correction value; ( ii ) a grinding angle of the grinding wheel 10; and (iii) an instruction as to which of the grinding patterns "push-cutting" or "draw-cutting" has been selected. On the other hand, the wear correction value calculating unit 21 supplies a wear correction value to be used for determining a correct position for the grinding wheel 10 to the robot driving control unit 14 through the bus 22 for every specified period of time or every specified operation amount.

The robot driving control unit 14 is composed of a microcomputer including a central processing unit (CPU) 14A for executing specified programs such as sequence control and operation control, a read only memory (ROM) 14B for storing the above programs and a random access memory (RAM) 14C in which working areas required for executing the above programs are set. Similarly, the wear correction value calculating unit 21 is composed of a microcomputer including a central processing unit (CPU) 21A for executing specified programs, a read only memory (ROM) 21B for storing the above programs and a random access memory (RAM) 21C in which working areas required for executing the above programs are set.

Figure 3:
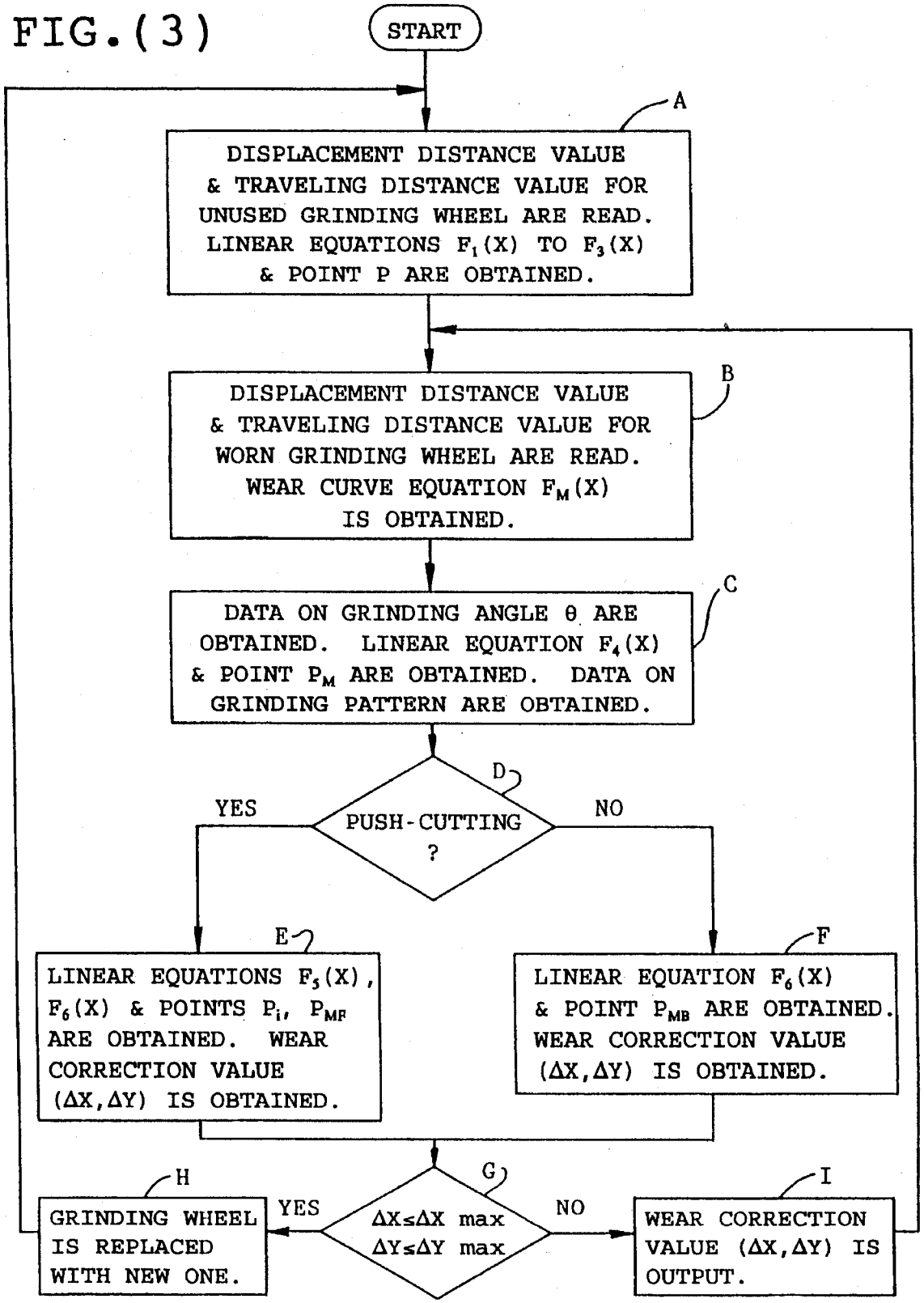

Reference will be made to the flow chart of FIG. 3, for explaining a basic operation that is performed based on a specified program stored in the ROM 21B and executed by the CPU 21A of the wear correction value calculating unit 21.

Figure 4:
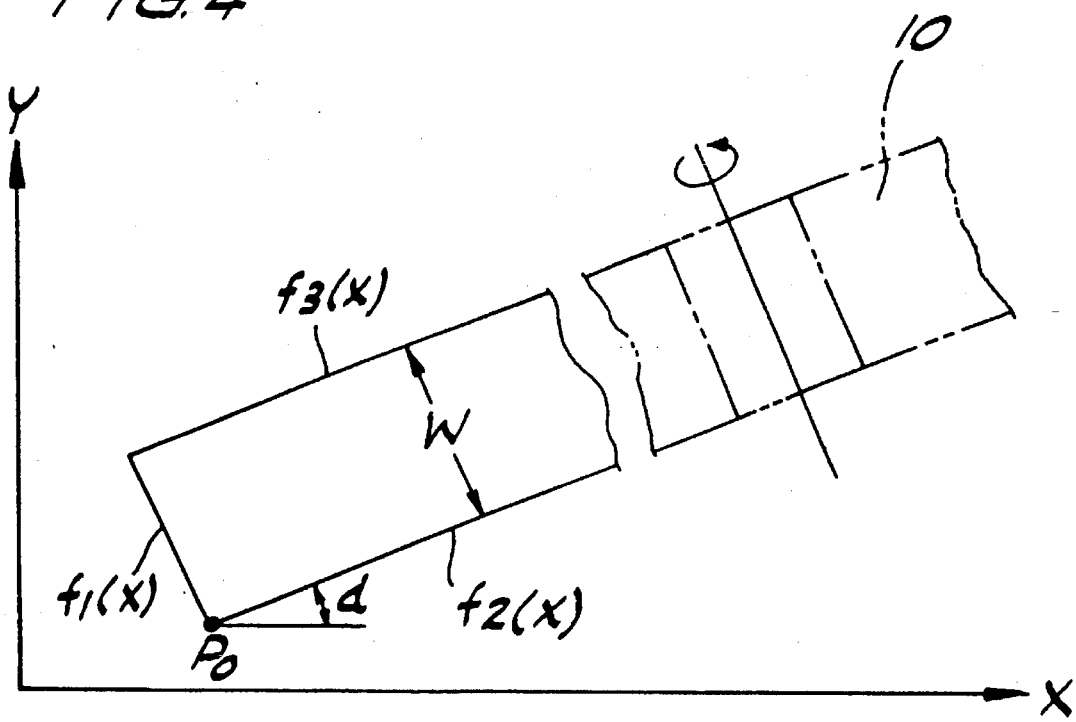

A. For grinding operation, a displacement distance value and a traveling distance value for the unused grinding wheel 10 are sequentially read from the laser displacement meter 15 and the linear scale 19 of the two-dimensional section measuring unit 20. Based on the displacement distance value and the traveling distance value, linear equations $f_1(x)$ to $f_3(x)$ and a point $P_0$ for a two-dimensional section of the unused grinding wheel 10, which are plotted in the X-Y coordinates of FIG. 4, are obtained in the following order:

1. first, the linear equation $f_1(x)$ for the side face of the grinding wheel 10 and the linear equation $f_2(x)$ for the bottom face of the grinding wheel 10 are sequentially obtained;
2. the line representing the linear equation $f_2(x)$ for the bottom face of the grinding wheel 10 is translated in parallel by the thickness W of the grinding wheel 10, thereby obtaining the linear equation $f_3(x)$ for the upper face of the grinding wheel 10; and
3. then, the point $P_0$ , at which the lines representing the linear equation $f_1(x)$ for the side face of the grinding wheel 10 and the linear equation $f_2(x)$ for the bottom face of the grinding wheel 10 intersect, is obtained, and the point $P_0$ is set as a tool centre point which serves as a control point for the robot 13. This tool centre point $P_0$ is a reference point.

Figure 5:
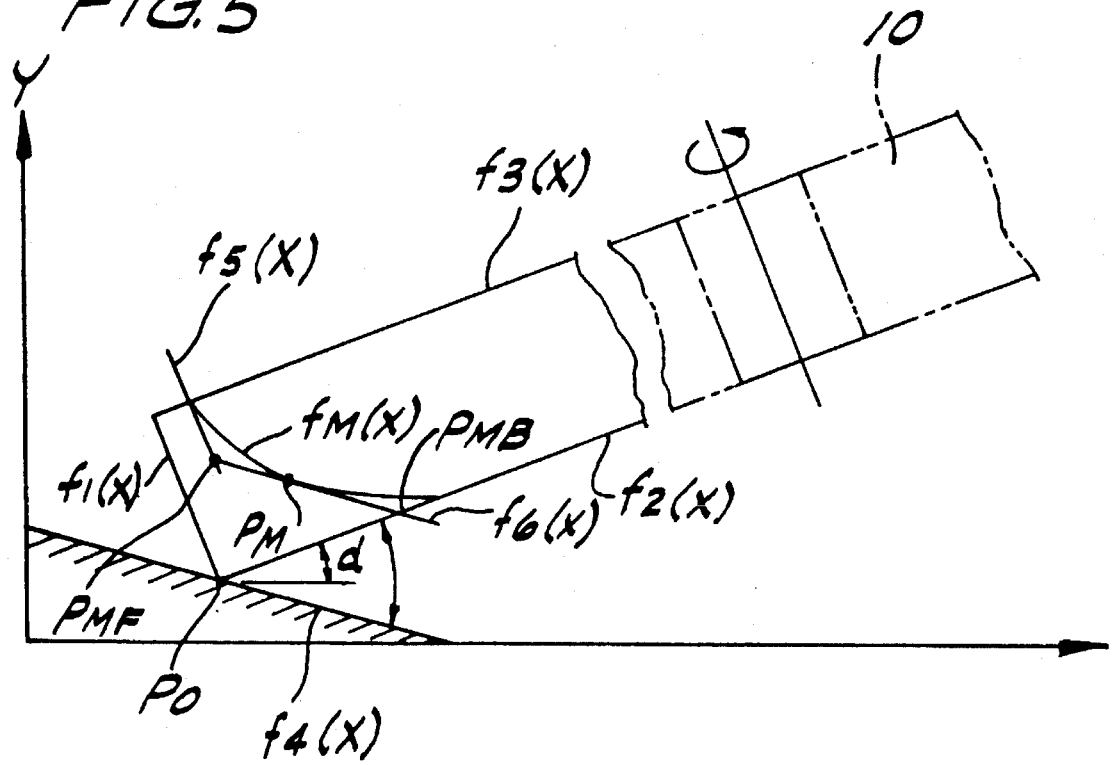

B. A displacement distance value and a traveling distance value for the grinding wheel 10 which is in a worn state after use for grinding operation are sequentially read from the laser displacement meter 15 and the linear scale 19 respectively. Based on the displacement distance value and the traveling distance value, a wear curve equation $f_M(x)$ for a two-dimensional section of the grinding wheel 10 in a worn state, which is plotted in the X-Y coordinates of FIG. 5, is obtained.

C. Data on a grinding angle θ of the grinding wheel 10 are obtained from the robot driving control unit 14, thereby obtaining a linear equation $f_4(x)$ for the grinding face of a workpiece as shown in FIG. 5. From the linear equation $f_4(x)$, a minimum distance point $P_M$ of the wear curve equation $f_M(x)$ is obtained. From the robot driving control unit 14, data as to which of the grinding patterns "push-cutting" or "draw-cutting" has been selected are obtained.

On the assumption that $P_A$ to $P_C$ represent positions at the finished grinding face of the workpiece, which are instructed to the robot 13, in the case of grinding pattern "push-cutting", if a point $T_A$ of the grinding wheel 10 is set as a tool centre point, less excessive cutting occurs as shown in FIG. 6(a). On the other hand, if a point $T_B$ of the grinding wheel 10 is set as a tool centre point, more excessive cutting will occur as shown in FIG. 6(*b*). In the case of grinding pattern "draw-cutting", when the point $T_B$ of the grinding wheel 10 is set as a tool centre point, less excessive cutting occurs as shown in FIG. 7(*a*), whereas when the point $T_A$ of the grinding wheel 10 is set as a tool centre point, more excessive cutting occurs as shown in FIG. 7(*b*).

D. It is judged from data supplied from the robot driving control unit 14 whether grinding pattern "push-cutting" or "draw-cutting" has been selected.

E. If grinding pattern "push-cutting" has been selected, linear equations $f_5(x)$, $f_6(x)$ for a two-dimensional section of the grinding wheel 10 and points $P_1$, $P_{MF}$ as shown in FIG. 5 as well as a wear correction value (ΔX, ΔY) are obtained in the following order:

1. first, the point $P_1$, at which the lines representing the wear curve equation $f_M(x)$ for the grinding wheel 10 and the linear equation $f_3(x)$ for the upper face of the grinding wheel 10 intersect, is obtained;
2. then, the line representing the linear equation $f_5(x)$, which passes through the point $P_1$ and is parallel to the line representing the linear equation $f_1(x)$ for the side face of the grinding wheel 10, is obtained. From the linear equation $f_4(x)$ for the grinding face of the workpiece, the line representing the linear equation $f_6(x)$, which passes through the minimum distance point $P_M$ of the wear curve equation $f_M(x)$ and is parallel to the line representing the linear equation $f_4(x)$, is also obtained;
3. the point $P_{MF}$, at which the lines representing the linear equation $f_5(x)$ and the linear equation $f_6(x)$ intersect, is obtained and set as the tool centre point which serves as a control point for the robot 13 in the case of grinding pattern "push-cutting"; and
4. finally, the positional difference (ΔX, ΔY) between the point $P_{MF}$ and the reference point (i.e., the tool centre point $P_O$ for the unused grinding wheel 10) is obtained. This positional difference (ΔX, ΔY) is the wear correction value.

F. In the case of grinding pattern "draw-cutting", the linear equation $f_6(x)$ for a two-dimensional section of the grinding wheel 10 and a point $P_{MB}$ as shown in FIG. 5 as well as the wear correction value (ΔX, ΔY) are obtained in the following order:

1. first, from the linear equation $f_4(x)$ for the grinding face of the workpiece, the line representing the linear equation $f_6(x)$, which passes through the minimum distance point $P_M$ of the wear curve equation $f_M(x)$ and is parallel to the line representing the linear equation $f_4(x)$, is obtained;
2. then, the point $P_{MB}$, at which the lines representing the linear equation $f_6(x)$ and the linear equation $f_2(x)$ for the bottom face of the grinding wheel 10 intersect, is obtained and set as the tool centre point for the robot 13 in the case of grinding pattern "draw-cutting"; and
3. finally, the positional difference (ΔX, ΔY) between the point $P_{MB}$ and the reference point (i.e., the tool centre point $P_O$ for the unused grinding wheel 10) is obtained and set as the wear correction value.

G. By judging whether the X-coordinate of the wear correction value ΔX (i.e., the wear amount of the grinding wheel 10 in its radial direction) is smaller than a specified value $\Delta X_{max}$ and whether the Y-coordinate of the wear correction value ΔY (i.e., the wear amount of the grinding wheel 10 in its axial direction) is smaller than a specified value $\Delta Y_{max}$, it is determined whether or not the grinding wheel 10 should be replaced with new one.

H. If the replacement is required, the grinding wheel 10 is replaced with new one, and the program goes back to Step A.

I. If the replacement is not required, the wear correction value (ΔX, ΔY) is supplied to the robot driving control unit 14 in order to correct the control point for the robot 13, namely, the tool centre point, and the program goes back to Step B.

When the two-dimensional section of the grinding wheel 10, which is cut off in an axial direction of the grinding wheel 10 so as to pass its rotary axis, is measured by means of the two-dimensional section measuring unit 20, the rotating speed of the grinding wheel 10 is higher than the horizontal traveling speed of the laser displacement meter 15 and the two-dimensional section is taken from the outest contour of a phantom image of the grinding wheel 10 created when being rotated.

Although data on the grinding angle θ for the grinding wheel 10 is supplied from the robot driving control unit 14 to the wear correction value calculating unit 21 in order to calculate the wear correction value (ΔX, ΔY) used for determining a correct position for the grinding wheel 10 in the foregoing embodiment, an alternative may be possible. For example, the grinding angle θ may be determined in the following way to supply to the robot driving control unit 14, in addition to the calculation of the wear correction value (ΔX, ΔY) in the wear correction value calculating unit 21.

Figure 8:
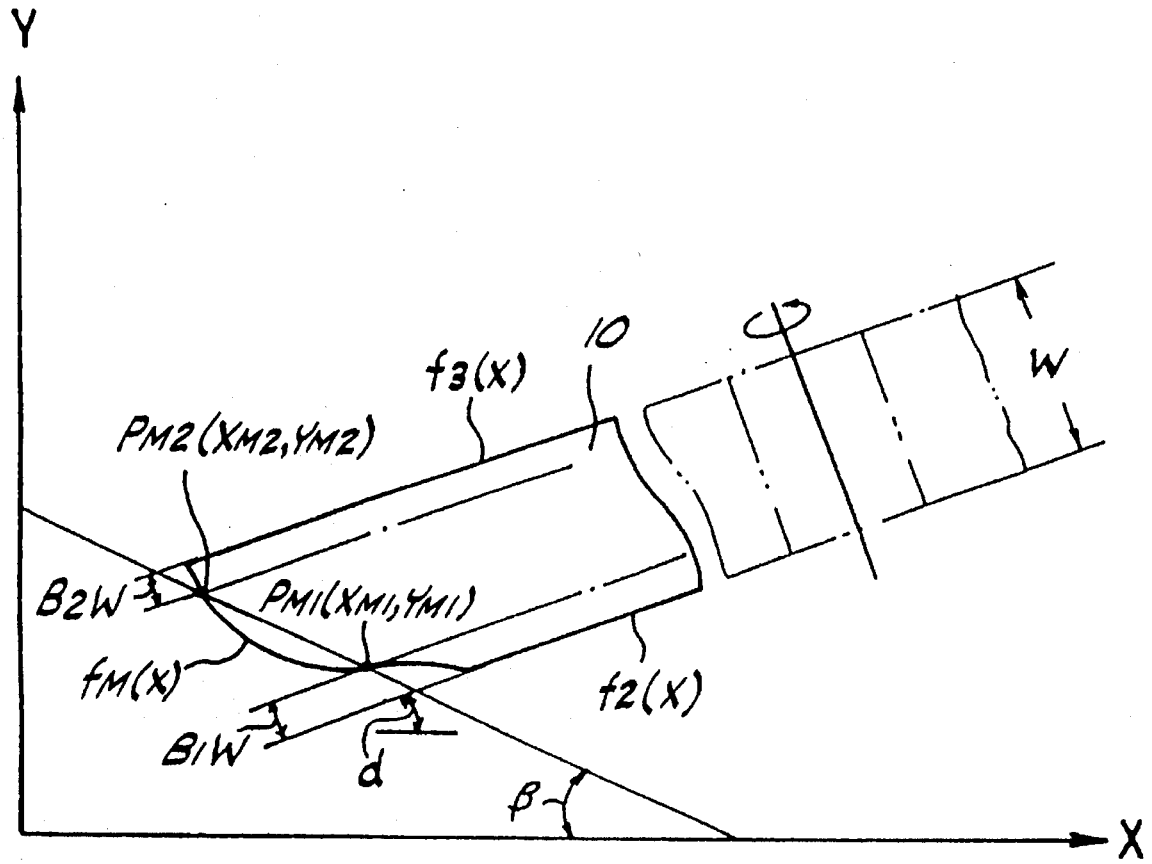
FIGS. 8 and 9 are for explaining a grinding wheel wear compensator according to another embodiment of the invention.
Figure 9:
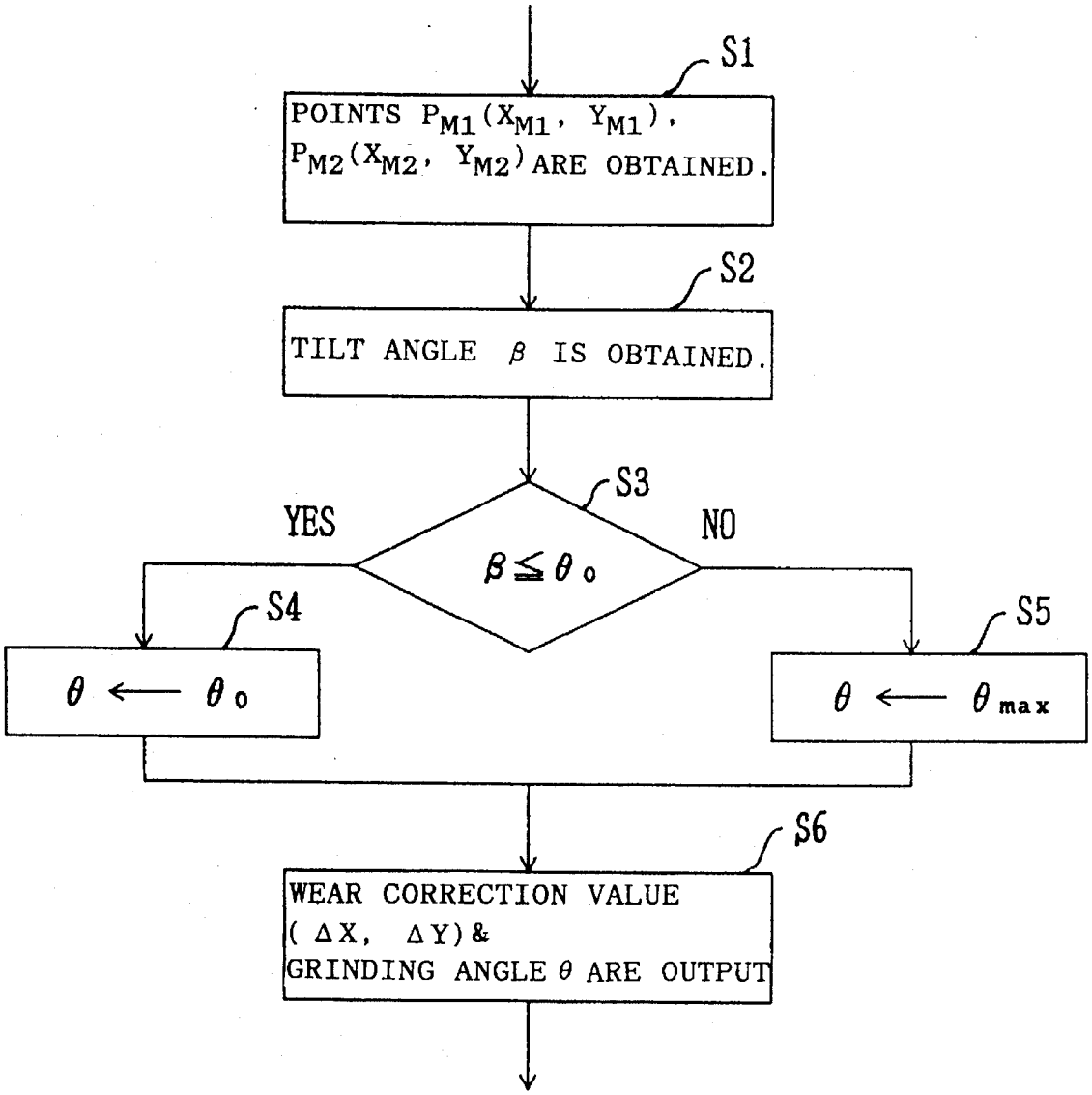

Firstly, two grinding angles are preliminarily set. For instance, one is a grinding angle $\theta_0$ optimum for grinding operation, ranging from 20° to 45°. The other is a grinding angle $\theta_{max}$ in the range of 60° to 80° that is intended for use when the grinding wheel 10 begins to wear flatly after use with the grinding angle $\theta_0$. In a normal situation, grinding is carried out with the grinding angle $\theta_0$. The judgment as to whether the grinding wheel 10 has worn flatly will be described below with reference to the flow chart of FIG. 9 as well as FIG. 8.

S-1: The line representing the linear equation $f_2(x)$ for the bottom face of the grinding wheel 10 is translated in parallel by $B_1$% of the thickness W of the grinding wheel 10 (a constant for determining a flat condition) and a point $P_{M1}$ ($X_{M1}$, $Y_{M1}$), at which the lines representing the translated linear equation and the wear curve equation $f_M(x)$ intersect, is obtained.

The line representing the 11near equation $f_3(x)$ for the upper face of the grinding wheel 10 is translated in parallel by $-B_2$% of the thickness W of the grinding wheel 10 (a constant for determining a flat condition) and a point $P_{M2}$ ($X_{M2}$, $Y_{M2}$), at which the lines representing the translated linear equation and the wear curve equation $f_M(x)$ intersect, is obtained.

S-2: A tilt angle β of the line between the point $P_{M1}$ ($X_{M1}$, $Y_{M1}$) and the point $P_{M2}$ ($X_{M2}$, $Y_{M2}$) is obtained, those points $P_{M1}$ and $P_{M2}$ being on the line representing the wear curve equation $f_M(x)$.

$$\beta = X_{M2}X_{M1}/Y_{M2}-Y_{M1}$$

S-3 to S-6: It is judged whether or not the tilt angle β is smaller than the specified angle $\theta_0$. If so, the grinding angle θ is set as the grinding angle $\theta_0$ and the linear equation $f_4(x)$ for the grinding face of the workpiece is obtained. If not, the grinding angle θ is set as the grinding angle $\theta_{max}$, and the linear equation $f_4(x)$ for the grinding face of the workpiece is obtained.

Other steps are the same as those of the foregoing embodiment, except that in addition to the wear correction value (ΔX, ΔY), the grinding angles $\theta_0$ and $\theta_{max}$ are supplied to the robot driving control unit 14.

In the above embodiment, linear regression etc. may be used when obtaining the linear equations $f_1(x)$ to $f_6(x)$ etc. Although the point $_0$ that is the tool centre point of the unused grinding wheel 10 is set as the reference point in the forgoing embodiment, the tool centre point used in the preceding measurement and calculation could be the reference point.

Figure 10:
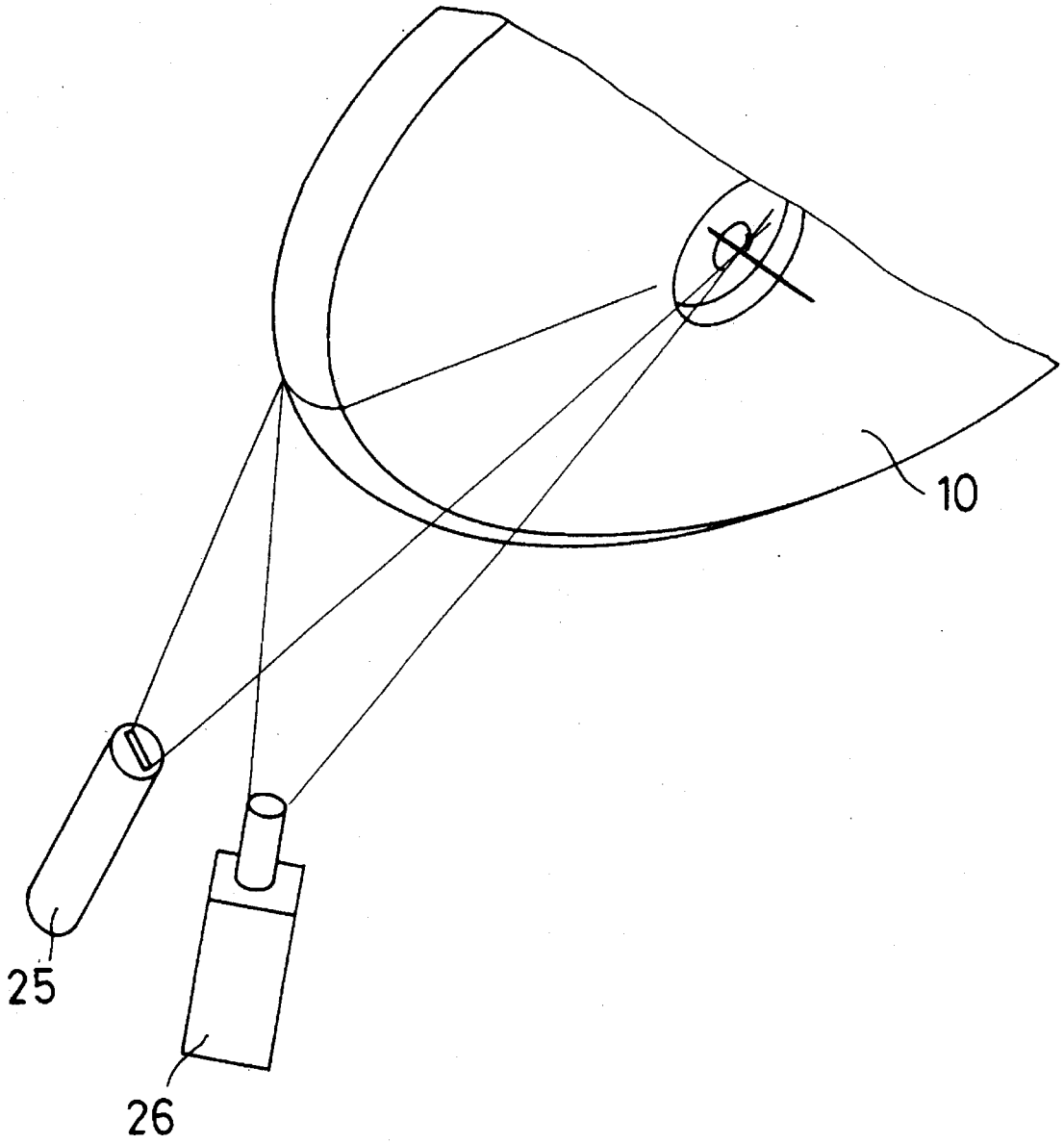
FIG. 10 is for explaining a modified example of the measurement of a two-dimensional section of a grinding wheel.

Further, in the above embodiment, in order to obtain the displacement distance value for the grinding wheel 10, an ultrasonic range finder may be used instead of the laser displacement meter 15. A two-dimensional section is detected by horizontally moving the laser displacement meter 15, but it may be detected by moving the operating arm 12 of the robot 13 for the laser displacement meter 15 (or the ultrasonic range finder) fixed, so that the laser displacement meter 15 etc. moves relative to the grinding wheel 10 at a constant speed in the radial direction of the grinding wheel 10. In such a case, it is necessary that the robot driving control unit 14 supplies data on the above constant speed to the wear correction value calculating unit 21. Further, the two-dimensional section of the grinding wheel 10, which is cut off in an axial direction of the grinding wheel 10 so as to pass its rotary axis, may be detected with a known image processing technique as disclosed in PCT/JP91/01349, using a slit light projector 25 and a photographing device 26 such as a CCD camera, from the slit light taken by the photographic device 26. In this case, as shown in FIG. 10, the slit light projector 25 projects slit light to the grinding wheel 10 from a side thereof so that the lengthwise direction of a slit light spot locates along the radial direction and the rotary axis of the grinding wheels 10, and the photographing device 26 takes, from a side, a picture of the slit light projected to the grinding wheel 10 by means of the slit light projector 25.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A grinding wheel wear compensator comprising:

(a) section detecting means for detecting a two-dimensional section of a grinding wheel, the section being cut off in an axial direction of the grinding wheel so as to pass a rotary axis of the grinding wheel;

(b) tool center determining means for determining a tool center point from the two-dimensional section of the grinding wheel detected by the section detecting means, in accordance with a desired grinding pattern for a workpiece to be ground; and (c) wear correction value calculating means for calculating a wear correction value used for determining a correct position for the grinding wheel, based on the positional difference between the tool centre point determined by the tool centre determining means and a reference point.

2. The grinding wheel wear compensator as claimed in claim 1, wherein said section detecting means comprises:

(a) a measuring device which is moved relative to the grinding wheel disposed in a fixed position in a radial direction of the grinding wheel and which measures the distance between the grinding wheel and the measuring device; and (b) a linear scale for measuring the traveling distance of the measuring device in a radial direction of the grinding wheel.

3. The grinding wheel wear compensator as claimed in claim 1, wherein said section detecting means comprises a measuring device which is moved relative to the grinding wheel at a specified speed in a radial direction of the grinding wheel and which measures the distance between the grinding wheel and the measuring device.

4. The grinding wheel wear compensator as claimed in claim 1, wherein said section detecting means comprises:

(a) slit light projecting means for projecting a slit light to the grinding wheel from a side thereof so that the lengthwise direction of a slit light spot locates along the radial direction and the rotary axis of the grinding wheels; and (b) photographing means for taking a picture of the slit light projected to the grinding wheel by the slit light projecting means.

5. The grinding wheel wear compensator as claimed in any one of claims 1 to 4, wherein said two-dimensional section of the grinding wheel, which is cut off in an axial direction of the grinding wheel so as to pass its rotary axis and is detected by the section detecting means, is taken from the outer contour of a phantom image of the grinding wheel created when the grinding wheel being rotated.

6. The grinding wheel wear compensator as claimed in any one of claims 1 to 4, wherein said determining means determines said center point as a function of said desired grinding pattern and wherein said desired grinding pattern is selected from a group comprising push-cutting patterns and draw-cutting patterns.

7. The grinding wheel wear compensator as claimed in any one of claims 1 to 4, wherein when a tool centre point is determined by the tool centre determining means, the tool centre point is determined based on an actual grinding angle for the grinding wheel, and with the actual grinding angle, grinding operation is performed.

8. The grinding wheel wear compensator as claimed in any one of claims 1 to 4, wherein, when a tool centre point is determined by the tool centre determining means, at least a first grinding angle that is optimum for grinding operation and a second grinding angle that is used when the grinding wheel wears flatly, are set prior to the determination of the tool centre point by the tool centre determining means, and the tool centre point is determined and grinding is performed with the first grinding angle when the operation is normally performed, and if the grinding wheel begins to wear flatly with the first grinding angle, the second angle is used for determining the tool centre point and performing the grinding operation.

9. The grinding wheel wear compensator as claimed in any one of claims 1 to 4, which is employed in a robot system used for grinding operation.

* * * * *